US005869225A

United States Patent [19]

Yamaya

[11] Patent Number: 5,869,225

[45] Date of Patent: Feb. 9, 1999

[54] PROCESSING METHOD OF SILVER HALIDE PHOTOGRAPHIC LIGHT SENSITIVE MATERIAL

[75] Inventor: Akiko Yamaya, Hino, Japan

[73] Assignee: Konica Corporation, Japan

[21] Appl. No.: 915,251

[22] Filed: Aug. 20, 1997

[30] Foreign Application Priority Data

Aug. 26, 1996 [JP] Japan ..... 8-242700

[51] Int. Cl.[6] ..... G03C 5/26

[52] U.S. Cl. ..... 430/440; 430/446; 430/458; 430/465; 430/963

[58] Field of Search ..... 430/440, 446, 430/458, 465, 963

[56] References Cited

U.S. PATENT DOCUMENTS 5,747,229 5/1998 Hasegawa ..... 430/465

FOREIGN PATENT DOCUMENTS 63-151943 6/1988 Japan .

63-151944 6/1988 Japan .

*Primary Examiner*—Hoa Van Le

*Attorney, Agent, or Firm*—Jordan B. Bierman; Bierman, Muserlian and Lucas

[57] ABSTRACT

A method for processing a silver halide photographic light sensitive material, using an automatic processor, the method comprising the steps of developing an exposed silver halide photographic light sensitive material with developer containing a compound represented by the following formula (1); and then fixing the developed material with fixer, formula (1)

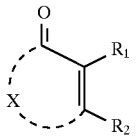

wherein the average flow velocity of the developer is 20 cm/second or more.

9 Claims, No Drawings

PROCESSING METHOD OF SILVER HALIDE PHOTOGRAPHIC LIGHT SENSITIVE MATERIAL

FIELD OF THE INVENTION

The invention relates to a method of processing a silver halide photographic light sensitive material and particularly to a method of processing a silver halide photographic light sensitive material which minimizes residual color in the processed material, improves glossiness, and increases CP (covering power).

BACKGROUND OF THE INVENTION

Currently, in processing an X-ray photographic light sensitive material for medical use, rapid processing, reduction of replenishing amount of photographic processing solutions and reduction of waste are sought. Much study has been made on photographic light sensitive materials, photographic processing solutions, and an automatic processors.

However, in rapidly processing the light sensitive materials with reduced replenishment of the processing solutions, there occur residual color and CP lowering in the processed materials. In order to minimize activity lowering of the processing solutions resulting from the reduced replenishment in the rapid processing, there is known a method of increasing the activity due to circulation and stirring of the solutions in an automatic processor. Regarding such a technique, a method is disclosed in Japanese Patent O.P.I. Publication Nos. 4-191737 and 5-66541 in which the photographic processing solutions are directly jetted on the emulsion layer surface of light sensitive material so that the solutions jetted on the emulsion layer surface are effectively substituted with fresh ones and the solutions easily permeate into the emulsion layer. However, these techniques have problems that satisfactory results are not obtained in minimizing residual color and increasing CP.

SUMMARY OF THE INVENTION

Accordingly, an object of the invention is to provide a method of processing a silver halide photographic light sensitive material which eliminates residual color in the processed material, and increases CP.

DETAILED DESCRIPTION OF THE INVENTION

The above object of the invention have been attained by the following:

1. a method for processing a silver halide photographic light sensitive material comprising a support and provided thereon, at least one silver halide emulsion layer, using an automatic processor, the method comprising the step of:
   developing the material with developer containing a compound represented by the following formula (1): formula (1)

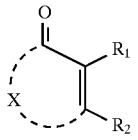

in which $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring, wherein the average flow velocity of the developer is 20 cm/second or more, 2. a method for processing a silver halide photographic light sensitive material comprising a support and provided thereon, at least one silver halide emulsion layer, using an automatic processor, the method comprising the steps of:
   developing the material with developer containing a compound represented by formula (1), and
   fixing the developed material with fixer, wherein the average flow velocity of the fixer is 20 cm/second or more,
3. a method for processing a silver halide photographic light sensitive material comprising a support and provided thereon, at least one silver halide emulsion layer, using an automatic processor, the method comprising the steps of:
   developing the material with developer containing a compound represented by the following formula (1), and
   fixing the developed material with fixer, wherein the average flow velocities of the developer and fixer are 20 cm/second or more,
4. the method of item 1, 2 or 3 above, wherein the replenishing amount of developer replenisher or fixer replenisher is 350 ml/$m^2$ or less,
5. the method of item 1, 2, 3 or 4 above, wherein the total processing time (Dry to Dry) is 30 seconds or less, or
6. the method of item 1, 2, 3, 4 or 5 above, wherein the developer is prepared by dissolving a solid developer composition in water, and the fixer is prepared by dissolving a solid fixer composition in water.

Next, the invention will be explained in detail.

The compound represented by the following formula (1) in the invention will be explained. formula (1)

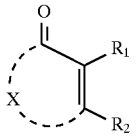

In formula (1), $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a ring, preferably comprising a carbon atom, a nitrogen atom or an oxygen atom, and to form a preferably 5- or 6-membered ring. Exemplarily, $R_1$ and $R_2$ independently represent a hydroxy group, an amino group (including a substituted amino group having as a substituent an alkyl group with 1 to 10 carbon atoms such as methyl, ethyl, n-butyl, hydroxyethyl), an acylamino group (for example, acetylamino, benzoylamino), an alkylsulfonylamino group (for example, methanesulfonylamino), an arylsulfonylamino group (for example, benzenesulfonylamino, p-toluenesulfonylamino), an alkoxycarbonylamino group (for example, methoxycarbonylamino), a mercapto group or an alkylthio group (for example, methylthio, ethylthio). The preferable $R_1$ and $R_2$ are a hydroxy group, an amino group, an acylamino group, an alkylsulfonylamino group, or an arylsulfonylamino group. X is comprised of preferably a carbon atom, a nitrogen atom or an oxygen atom, and forms a 5- or 6-membered ring. The example of X includes —O—, —C($R_3$)($R_4$)—, —C($R_5$)═, —C(═O)—, —N($R_6$)—, and —N═, wherein $R_3$, $R_4$ $R_5$ and $R_6$ independently represent a hydrogen group, a hydroxy group, a carboxy group, an alkyl group with 1 to 10 carbon atoms, which may have a substituent including a hydroxy group, a carboxy group and a sulfo group, or an aryl group with 6 to 15 carbon atoms, which may have a substituent including an alkyl group, a halogen atom, a hydroxy group, a carboxy group and a sulfo group. The 5- or 6-membered ring may be a saturated or unsaturated condensed ring. The example of the 5- or 6-membered ring includes a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and an uracil ring, and the preferable are a dihydrofuranone ring, a cyclopentenone ring, a cyclohexenone ring, a pyrazolinone ring, an azacyclohexenone ring or an uracil ring. The example of the compound represented by formula (1) in the invention is listed below, but is not limited thereto.

A-1

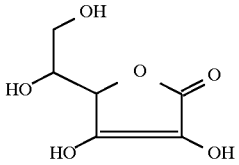

A-2

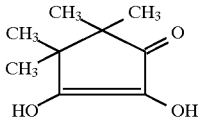

A-3

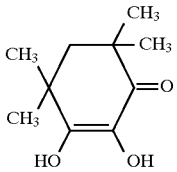

A-4

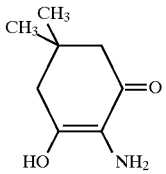

A-5

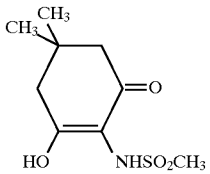

A-6

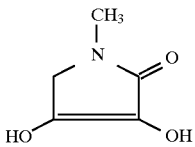

-continued

A-7

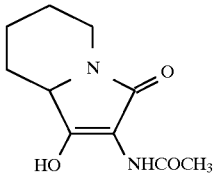

A-8

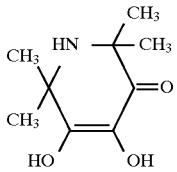

A-9

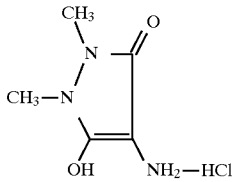

A-10

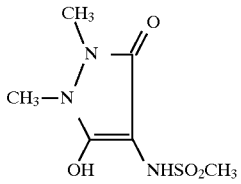

A-11

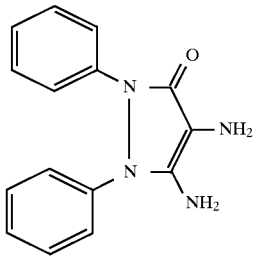

A-12

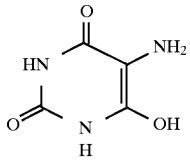

A-13

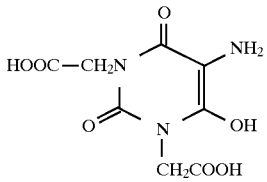

A-14

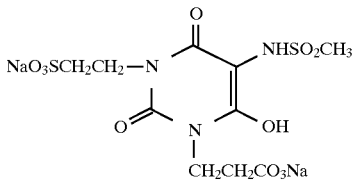

-continued

A-15

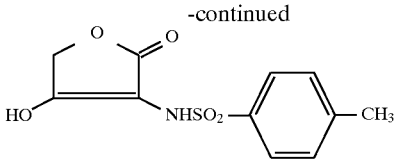

A-16

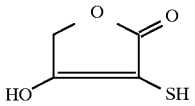

A-17

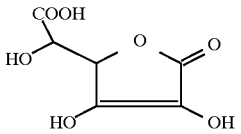

A-18

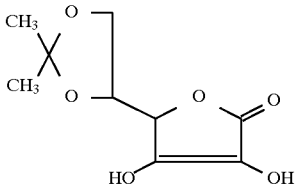

A-19

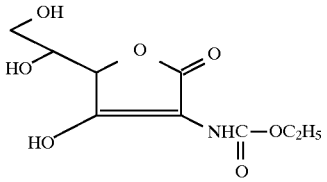

A-20

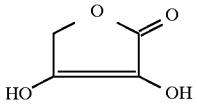

A-21

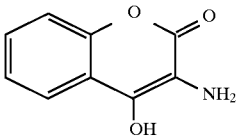

A-22

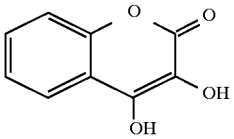

A-23

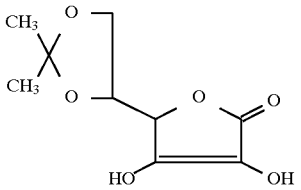

The compound represented by formula (1) (hereinafter referred to also as reductone) used in the invention includes an alkali metal salt thereof such as a lithium, sodium or potassium salt thereof. Among the reductones, the especially preferable is ascorbic acid or erythorbic acid, which is represented by formula A-1. These reductones are used in an amount of preferably 0.005 to 1.0 mol, and more preferably 0.1 to 0.5 mol per liter of developer. The developer used in the invention has a pH of preferably 9.0 to 11.0, and more preferably 9.5 to 10.5.

In addition to the above reductones, the developer used in the invention can contain dihydroxybenzenes (for example, hydroquinone, chlorohydroquinone, bromohydroquinone, 2,3-dichlorohydroquinone, isopropylhydroquinone or 2,5-dimethylhydroquinone), 3-pyrazolidones (for example, 1-phenyl-3-pyrazolidone, 1-phenyl-4-methyl-3-pyrazolidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone), 3-aminopyrazolines (for example, 1-(p-hydroxyphenyl)-3-aminopyrazoline, 1-(p-methylaminophenyl)-3-aminopyrazoline, 1-(p-amino-m-methylphenyl)-3-aminopyrazoline, and phenylene diamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline).

The aminophenols can be also used as auxiliary developing agents. The p-aminophenols include 4-aminophenol, 4-amino-3-methyl-aminophenol, 4-(N-methyl) aminophenol, 2,4-diaminophenol, N-(4-hydroxyphenyl) glycine, N-(2'-hydroxyethyl)-2-aminophenol, 2-hydroxymethyl-4-aminophenol, and 2-hydroxymethyl-4-(N-methyl), and their hydrochloric acid or surfuric acid salt.

Amine compounds can be added to the developer, and as the amine compounds are preferable those disclosed in U.S. Pat. No. 4,269,929. The developer used in the present invention needs to contain a buffer. Examples of buffers include sodium carbonate, potassium carbonate, sodium bicarbonate, potassium bicarbonate, trisodium phosphate, tripotassium phosphate, disodium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). In the invention, the developer containing reductons preferably contain carbonates. The buffer concentration of the developer is 0.3 mol/liter, and preferably 0.5 to 1.5 mol/liter.

As developing accelerators can be optionally added thioether compounds, p-phenylenediamine compounds, quaternary ammonium salts, amine compounds, polyalkylene oxides, hydrazines, ionic compounds, and imidazoles.

As antifoggant can be used KBr or organic antifoggants. The organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole and hydroxyazaindolidine, adenine and 1-phenyl-5-mercaptotetrazole as a representative.

The compounds represented by formuls (I), (II), (III) and (IV) disclosed in Japanese Patent O.P.I. Publication No. 7-114153 can be used, but the developer in the invention containing the reductones preferably contains a formula (I-d) compound disclosed in Japanese Patent O.P.I. Publication No. 7-114153.

In the developer of the present invention may be optionally used organic solvents such as methylcellosolve, methanol, acetone, dimethylformamide, cyclodextrins and compounds disclosed in Japanese Patent Examined Publication Nos. 47-33378/1972 and 44-9509/1969 in order to increase solubility of a developing agent.

In addition, various other additives such as antistaining agents, antisludging agents and developing accelerators may be added.

The developer in the invention preferably contains an iodide ion, and it is especially preferable that the developer contains the iodide ion in an amount of $2\times10^{-4}$ to $4\times10^{-3}$ mol/liter. The iodide ion promotes increase of CP, and particularly when a reductone-containing developer contains the iodide ion, CP greatly increases. Developer used in the invention is preferably a developer obtained by dissolving a solid developing composition kit in water. The kit is preferable in view of space-saving.

Before processing, starter is preferably added, and solidified starter is also preferably added. As starter, organic acids such as polycarboxylic acid compounds, alkali metal halides such as KBr, organic inhibitors and developing accelerators are used.

The replenishing amount of developer is preferably not more than 350 ml/m$^2$, more preferably 50 to 300 ml/m$^2$, and still more preferably 80 to 200 ml/m$^2$. The invention is greatly effective in that preferred replenishing amount of the developer.

The developing temperature of developer is preferably 25° to 50° C., and more preferably 30° to 40° C. The developing time is preferably 5 to 25 seconds and more preferably 5 to 15 seconds.

Next, the fixer used in the invention will be explained.

The fixer preferably contains a thiosulfate as a fixing agent. The thiosulfate includes a lithium, potassium, sodium or ammonium thiosulfate. The sodium or ammonium thiosulfate is preferred in terms of fixing speed.

As another fixing agent, iodides or thiocyanates can be used. The fixer contains a sulfite. The sulfite includes a solid lithium, potassium, sodium or ammonium sulfite. The fixer may contain a water soluble chromate salt or aluminium salt. The water soluble chromate salt includes chromium alum. The water soluble aluminum salt includes aluminum sulfate, potassium aluminum chloride, and aluminum chloride.

The fixer contains an acetate ion. Any compound capable of releasing the acetate ion in the Fixer can be used, and the compound includes acetic acid, and a lithium, potassium, sodium or ammonium acetate. The sodium or ammonium acetate is especially preferable.

A solid (powder) water-soluble aluminum salt generally has plural crystal water, and forms a tetradecyl to octadecyl hydrate salt. When such an aluminum salt is used in the solid processing composition, the solid composition is hardened by movement of the crystal water, and colored by reaction of an acid with hypo. Accordingly, the aluminum salt is preferably subjected to low temperature (60° C., temperature considered to be maximum under storage) treatment so that some of the crystal water are removed to obtain an equilibrium crystal water content. For example, according to the above treatment, a 14 to 18 hydrate salt of aluminum is preferably subjected to the above treatment to a 4 to 6 hydrate salt of aluminum.

Citric acid or β-alanine can be used as a buffering agent.

The fixer may contains citric acid, tartaric acid, malic acid, or phenylacetic acid or their optical isomers. Their salt includes a lithium, potassium, sodium or ammonium acetate such as potassium citrate, lithium citrate, sodium citrate, ammonium citrate, litium hydrogen tartarate, potassium hydrogen tartarate, potassium tartarate, sodium hydrogen tartarate, sodium tartarate, ammonium hydrogen tartarate, ammonium potassium tartarate, sodium potassium tartarate, sodium malate, ammonium malate, sodium succinate, or ammonium succinate.

Among the above compounds, citric acid, isocitric acid, malic acid, phenylacetic acid and their salts are preferable. Another acid includes an inorganic acid such as sulfuric acid, hydrochloric acid, nitric acid or boric acid and an organic acid such as formic acid, propionic acid or oxalic acid. The preferable is boric acid, an aminopolycarboxylic acid or their salt.

The chelating agent includes nitrilotriacetic acid, ethylenediaminetetraacetic acid, an aminopolycarboxylic acid and thier salt.

The surfactant includes an anionic surfactant such as a sulfate ester or a sulfonate, a nonionic surfactant such as a polyethylene glycol or ester surfactant, and an amphoteric surfactant.

A lubricant includes alkanol amines or alkylene glycols.

A fixing accelerator includes thiourea derivatives, alcohols having a triple bond in the molecule, and thioethers.

The pH of the fixer is 3.8 or more and preferably 4.2 to 5.5.

The fixing time is preferably 5 to 25 seconds, and more preferably 5 to 15 seconds.

The replenishing amount of fixer is preferably not more than 350 ml/m$^2$, more preferably 50 to 300 ml/m$^2$, and still more preferably 80 to 200 ml/m$^2$.

In the invention, the average flow velocity of developer (or fixer) is an average of flow velocities at the following three portions in the developer (or fixer) tank of the automatic processor:

When the developer tank (or the fixer tank) of the automatic processor is filled with developer (or fixer), 1. a portion which is 3 cm downward away from the developer (or fixer) surface and is 1 cm distant from the developer (or fixer) rack rollers,
2. a portion which is 3 cm upward away from the developer (or fixer) tank bottom and is 1 cm distant from the developer (or fixer) rack rollers, and
3. the center portion which is between the above 1 and 2 portions, and is 1 cm distant from the developer (or fixer) rack rollers.

The flow velocity is measured by a three-dimensional velocimeter produced by Chuo Kosoku Co., Ltd. In the invention, the light sensitive material is incorporated in the entire path of the tank, and, 3 minutes after transporting of the the light sensitive material is stopped, flow velocities are measured at the above three portions. The flow velocity is obtained by the following equation:

$$V=(Vx^2+Vy^2+Vz^2)^{0.5}$$

wherein V represents flow velocity, Vx represents flow velocity of an x direction, Vy represents flow velocity of a y direction, and Vz represents flow velocity of a z direction.

In the invention, the average flow velocity of developer is 20 cm/second or more, but is preferably 25 cm/second or more, and more preferably 25 to 80 cm/second.

Means for obtaining the above average flow velocity of developer is any, and is not specifically limited. For example, the flow velocity can be controlled by the number of a discharging port of circulated developer to the developer tank, an area of the port, positions of the port, a discharging amount of developer, a discharging velocity of developer, a developer tank shape, a flow adjustment plate or their combinations.

The total processing time (Dry to Dry time) is preferably 30 seconds or less, more preferably 25 seconds or less, and still more preferably 15 to 25 seconds. The total processing time herein referred to implies time necessary to develop, fix, wash and dry a light sensitive material.

In the invention, developer is preferably replenished with developer replenisher, and fixer is preferably replenished with fixer replenisher.

The photographic processing composition used in the invention such as developer or fixer is preferably prepared by solidifying a processing composition and then dissolving the solidified composition in water.

Next, solidifying of photogaraphic processing compositions will be explained.

In order to solidify the photographic processing composition, any method can be used in which concentrated solution or a mixture of fine-powdered or granuled processing agents with a water soluble binder is kneaded and molded or pre-molded processing agent is coated with a covered layer by spraying a water soluble binder. (See JP Application Nos. 2-135887/1990, 2-203165/1990, 2-203166/1990, 2-203167/1990, and 2-300405/1990.)

The preferable method for preparing tablets is a method in which a powedered processing composition is granulated and the resulting granules are tableted to obtain tablets. The tablets prepared by the above have advantages that solubility and storage stability are improved and stable photographic properties are obtained as compared with those prepared by the method that the solid processing composition is only mixed and then tableted.

As for the granulating processes for forming tablets, it is possible to use any of the well-known processes such as the processes of a rolling granulation, an extrusion granulation, a compression granulation, a cracking granulation, a stirring granulation, a fluidized-layer granulation and a spray-dry granulation. When the granules are mixed and compressed to obtain tablets, the average particle size of the granules is to be within the range of preferably 100 to 800 $\mu$m and more preferably 200 to 750 $\mu$m in that localization of components or so-called segregation occurs with difficulty. As to particle size distribution, not less than 60% of the granules have a deviation of preferably ±100 to 150 $\mu$m. The granules are used as they are.

When the granules are compressed, the well known compressors such as a hydraulic press machine, a single tableting machine, a rotary tableting machine and a bricketing machine can be used. The resulting solid processing composition may be in any form, and preferably in cylindrical form in view of productivity, handling or loose powder occurred in use.

It is preferable that each component, for example, an alkali agent, a reducing agent, a bleaching agent, or a preservative, is separately granulated. As a result, the above effects become more remarkable.

A tablet type processing composition can be prepared in any well known process or the method detailed in JP OPI Publication Nos. 51-61837/1976, 54-155038/1979 and 52-88025/1977 and British Patent No. 1,213,808. Also, the preparation of the granulated processing composition is detailed in JP OPI Publication Nos. 2-109042/1990, 2-109043/1990, 3-39735/1991 and 3-39739/1991. Further, a powder type processing composition can be prepared in any well known process as detailed in JP OPI Publication No. 54-133332/1979, British Patent Nos. 725,892 and 729,862 and German Patent No. 3,733,861.

From the viewpoint of solubility and the desired effect of the present invention, the bulk density of the solid photographic processing composition described above is preferably 1.0 to 2.5 g/cm$^3$; this range is preferable from the viewpoint of solid strength for the lower limit and solid solubility for the upper limit. When the solid processing composition is of granule or powder form, the bulk density is preferably 0.40 to 0.95 g/cm$^3$.

Although solidification of part of a processing composition is included in the scope of the present invention, it is preferable to solidify the entire components of the processing composition. Desirably, each component is formed as a separate solid processing agent and packaged in the same package. It is also desirable to package each component in the order of repeated addition.

It is preferable to add all processing agents to be supplied to respective processing tanks according to information on the amount of processing in the form of solid. Where necessary, replenishing water is supplied on the basis of such information or other replenishing water controlling information. In this case, the liquid added to the processing tanks may be replenishing water alone. In other words, when two or more processing tanks require replenishment, by sharing the replenishing water, only one tank is sufficient to store the replenishing liquid, resulting in automatic processor size reduction. The replenishing water tank may be installed outside or inside the automatic processor machine. It is preferable in view of space saving that the replenishing water tank be installed inside the automatic processor.

In solidifying a developing composition, it is preferable to solidify all of an alkali agent and reducing agent, and to confine the number of tablet kinds to not more than 3, preferably 1. When solidifying in two or more agents, it is preferable to package these tablets or granules in the same package.

The solid processing composition used in the invention can be packaged with the following materials: As for a synthetic resin material, any material can be used upon selecting them from the group consisting of polyethylene (prepared in either a high-pressure method or a low-pressure method), polypropylene (prepared in either a non-stretching method or a stretching method), polyvinyl chloride, polyvinyl acetate, Nylon (either stretched or non-stretched), polyvinylidene chloride, polystyrene, polycarbonate, Vinylon, Eval, polyethylene terephthalate (PET), other polyesters, rubber hydrochloride, acrylonitrile-butadiene copolymer and an epoxy-phosphoric acid type resin (that is a polymer described in JP OPI Publication Nos. 63-63037/1988 and 57-32952/1982). Besides the above, a pulp may also be used.

The material is preferably made of a single material, but, as film is used one which a synthetic resin film is laminated or coated or one of single layer.

It is more preferable to use various gas-barrier layers. For example, either an aluminium foil or an aluminium-vacuum-evaporated synthetic resin is interposed between the above-mentioned two synthetic resin films.

The total oxygen transmittance of the packaging material is not higher than 50 ml/m$^2$ 24 hr/atm (at 20° C. and 65% RH) and, preferably, not higher than 30 ml/m$^2$ 24 hrs/atm in view of stotage stability or prevention of staining occurrence.

The total layer thickness of the laminated layer or single layer is 1 to 3000 $\mu$m, preferably 10 to 2000 $\mu$m and, more preferably 50 to 1000 $\mu$m.

The above-mentioned synthetic resin film may consist of either a single (macromolecular) resin film or a film in which two or more resins are laminated.

The single macromolecular resin film satisfying the requirements for the invention includes, for example, (1) polyethylene terephthalate (PET) having a thickness of not thinner than 0.1 mm;

(2) an acrylonitrile-butadiene copolymer having a thickness of not thinner than 0.3 mm; and (3) a hydrochloric rubber having a thickness of not thinner than 0.1 mm.

Among the above, polyethylene terephthalate can suitably be applied to the invention, because it is excellent in alkali resistance and acid resistance, too.

Next, a laminated macromolecular resin film satisfying the requirements for the invention includes, for example, (4) PET/polyvinyl alcohol-ethylene copolymer (Eval)/polyethylene (PE);

(5) stretched polypropylene (OPP)/Eval/PE;

(6) unstretched polyproylene (CPP)/Eval/PE;

(7) Nylon (N)/Aluminium foil (Al)/PE;

(8) PET/Al/PE;

(9) Cellophane/PE/Al/PE;

(10) Al/paper/PE;

(11) PET/PE/Al/PE;

(12) N/PE/Al/PE;

(13) paper/PE/Al/PE;

(14) PET/Al/PET/polypropylene (PP);

(15) PET/Al/PET/high-density polyethylene (HDPE);

(16) PET/Al/PE/low-density polyethylene (LDPE);

(17) Eval/PP;

(18) PET/Al/PP;

(19) paper/Al/PE;

(20) PE/PVDC-coated Nylon/PE/ethylvinyl acetate-polyethylene condensate (EVA);

(21) PE/PVDC-coated N/PE;

(22) EVA/PE/Aluminium-evaporated Nylon/PE/EVA;

(23) aluminium-evaporated Nylon/N/PE/EVA;

(24) OPP/PVDC-coated N/PE;

(25) PE/PVDC-coated N/PE;

(26) OPP/Eval/LDPE;

(27) OPP/Eval/CPP;

(28) PET/Eval/LDPE;

(29) ON (stretched Nylon,/Eval/LDPE; and

(30) CN (unstretched Nylon)/Eval/LDPE.

Among them, the above-given (20) through (30) may preferably be used.

Further, the foregoing packaging material is typically constituted of the following component arrangements in the order from the inside thereof, provided when the side attached to a processing composition is regarded as the inside.

PE/paper sheet as a principal member/PE/Al/an epoxy-phosphoric acid type resin layer/a polyester type resin layer/PE;

PE/K-Nylon/PE or an adhesive/Al/PE/paper sheet/PE;

PE/Vinylon/PE or an adhesive/Al/PE/paper sheet/PE;

PE/vinylidene chloride/PE or an adhesive/Al/PE/paper sheet/PE;

PE/polyester/PE or an adhesive/Al/PE/Paper sheet/PE; and

Polypropylene/K-Nylon/polypropylene/Al/polypropylene/paper sheet/polypropylene.

A mode of moisture-resistibly packaging powder, tablet or granule includes, for example, 4-side sealing; 3-side sealing; Stick-sealing (such as a pillow type or gusset type packaging); PTP sealing; and Cartridge sealing.

Four-side sealing mode, 3-side sealing mode and stick-sealing mode (such as a pillow or cassette type sealing mode) are different in shape from each other and the above-given materials may be used therein, provided, when these modes are used in a peal-open system, a sealant is laminated so as to provided them with a peal-open aptitude.

As for the above-mentioned peal-open system, there are, ordinarily, a cohesion-rupture system, an interface pealing system and a interlayer pealing system.

To be more concrete, the cohesion-rupture system is a system in which an adhesive so-called a hot-melt and a heat-seal lacquer are both used as a sealer. When opening a package, the inside of a sealant layer is cohesion-ruptured and thereby the package is peal-opened.

The interface pealing system is a system for pealing on the interface between films, in which a sealing film (that is a sealant) and an adherend are not completely fused together and, therefore, they can be pealed apart by applying an appropriate force. The sealant is a film prepared by mixing plural tacky resins up, and it may be selected out of the group consisting of polyethylene, polypropylene and a copolymer thereof, a polyester and so forth, so as to meet a material of the adherend.

The foregoing interlayer pealing system is a system in which a multilayered extrusion film such as a laminated film is used as a sealant and a pealing is then made on the interface between the laminated layers of the film.

Among the peal-open systems applied with a film of the invention, an interlayer pealing system and an interface pealing system are preferable.

Because such a sealant as mentioned above is thin, it is usual to use it upon laminating it on any one of the other films including, for example, those made of polyethylene, polypropylene, polystyrene, polycarbonate, polyester (such as polyethylene terephthalate), polyvinyl chloride, Nylon, Ever, or aluminium. However, taking a moisture resistance, an environmental aptitude and a compatibility with a content into consideration, polyethylene, polypropylene, polyester and ever may preferably be used. Also, taking a printability into consideration, the outermost surface is preferable to be comprised of, for example, a unstretched polypropylene polyester and paper sheet.

A sealant includes, for example, CMPS film manufactured by Tocello Co., Difran PP-100 and PS-300 each manufactured by Dai-Nippon Ink Chemical Co., LTS film manufactured by Toppan Printing Co. and San-Seal FR and MS each manufactured by Sanei Chemical Co. A type thereof which already laminated with a polyester include, for example, Dikran C-1600T and C-1602T.

PTP has a packaging mode in which a solid type processing composition is put in a PVC- or CPP-made sheet-shaped package that is a blister type package and then the package is heat-sealed by making use of an aluminium sealing material.

From the viewpoint of preserving the environment to be safe, A-PET and a high moisture resistive PP (such as TAS-1130, TAS-2230 and TAS-3230 each manufactured by Taisei Chemical Industrial Co.) have recently been preferably used, while there has been a tendency to ban the use of PVC as a packaging material.

When packaging, binding or covering a processing composition by making use of a water-soluble film or a binder, a water-soluble film or binder preferably applicable thereto include, for example, those comprising the following basic materials, namely, those of polyvinyl alcohol, methyl cellulose, polyethylene oxide, starch, polyvinyl pyrrolidone, hydroxypropyl cellulose, pullulan, dextran, gum arabic, polyvinyl acetate, hydroxyethyl cellulose, carboxyethyl cellulose, sodium carboxymethyl hydroxy ethyl cellulose, poly(alkyl)oxazoline and polyethylene glycol. Among them, those of the polyvinyl alcohol type and pullulan type are preferably used, from the viewpoint of a covering or binding effect.

Polyvinyl alcohol is an especially suitable film-forming material and is also excellent in strength and softness under almost all conditions. A polyvinyl alcohol composition available on the market for casting it into a film has a variety of molecular weight ranges and hydrolyzing degrees, however, it is preferable to have a molecular weight within the range of about 10000 to about 100000. A hydrolyzing degree herein means a ratio of an acetic acid ester group of polyvinyl alcohol to be substituted by an hydroxyl group. In the case of a film, the degrees of a hydrolysis is usually within the range of about 70% to 100%. As mentioned above, the term, "polyvinyl alcohol", usually includes a polyvinyl acetate compound.

The above-mentioned water-soluble film is prepared in such a common preparation process as described in, for example, JP OPI Publication Nos. 2-124945/1990, 61-97348/1986, 60-158245/1985, 2-86638/1990, 57-117867/1982, 2-75650/1990, 59-226018/1984, 63-218741/1988 and 54-13565/1979.

As for these water-soluble films, it is allowed to use those available on the market, under the brand names of, for example, Solpuron (manufactured by Ai-Cello Chemical Co.), Hicellon (manufactured by Nichigo Film Co.) and pullulan (manufactured by Hayashibara Co.). In particular, Series of 7-000 of polyvinyl alcohol film available from Mono-Sol Division of Chris Craft Industries, Inc. can preferably be used, because it may be dissolved in water, without harm, at a temperature within the range of about 34° F. to about 200° F. and shows a high chemically resistant property.

The above-mentioned water-soluble film preferably applicable thereto has a thickness within the range of 10 to 120 $\mu$m, preferably 15 to 80 $\mu$m and more preferably 20 to 60 $\mu$m, from the viewpoints of the preservation stability of a solid type processing composition, a period of time required for dissolving the water-soluble film and the crystal deposition produced inside an automatic processor.

It is also preferable that a water-soluble film is of the thermoplastic type. This is not only because a heat-sealing process and a supersonic welding process may readily be performed, but also because a covering effect may more excellently be displayed.

Further, the tensile strength of a water-soluble film is within the range of, preferably $0.5\times10^6$ to $50\times10^6$ kg/m$^2$, more preferably $1\times10^6$ to $25\times10^6$ kg/m$^2$ and, particularly $1.5\times10^6$ to $10\times10^6$ kg/m$^2$. Such a tensile strength as mentioned above can be measured in conformity of the method specified in JIS Z-1521.

A photographic processing composition packaged, bound or covered by a water-soluble film or a binder is preferable to be packaged with a moisture resistive material, for such a purpose that a high moisture including, for example, the atmospheric moisture such as rain and mist, and an accidental damage produced by spattering or touching the composition by wet hand may be prevented in the course of storing, transporting or handling the composition. As for such a moisture resistive material as mentioned above it is preferable to use a film having a thickness within the range of 10 to 150 $\mu$m. The moisture resistive material is preferable to be at least one selected from the group consisting of the following film or a composite material thereof; namely, a polyolefin film such as those made of polyethylene terephthalate, polyethylene and polypropylene; a craft paper capable of showing a moisture resistant effect displayed by polyethylene; a wax paper; a moisture resistive cellophane; glassine, polyester, polystyrene, polyvinyl chloride, polyvinylidene chloride, polyamide, polycarbonate, acrylonitrile; a metal foil such as that made of aluminium; and a metallized polymer.

In an embodiment of the invention, it is preferable to use a moisture resistive packaging material comprising a decomposable plastic including, particularly, a biodegradable or photolysable plastic.

The biodegradable plastics include, for example, (1) a plastic comprising natural macromolecules, (2) a microbially produced polymer, (3) a synthetic polymer having a well biodegradation property, and (4) a plastic compounded with a biodegradable natural macromolecule. The photolysable plastics include, for example, (5) a plastic excited by UV rays and having a group capable of cutting a chain made present on the principal chain thereof. Besides the above-given macromolecules, those having both of the two functions, a photolysability and a biodegradability together, may effectively be used.

The typical examples thereof will typically be given below.

The biodegradable plastics include, for example, (1) A natural macromolecule;

A polysaccharide, a cellulose, a polylactic acid, chitin, chitosan, a polyamino acid, or a modified matter thereof;

(2) A microbially produced polymer;

"Biopol" comprising PHB-PHV (a 3-hydroxy butylate-3-hydroxy valeate copolymer) and a microbially produced cellulose;

(3) A synthetic polymer having a well biodegradation property;

A polyvinyl alcohol, a polycaprolactone, and a copolymer or mixture thereof; and (4) A plastic compounded with a biodegradable natural macromolecule;

A natural macromolecule having a well biodegradability include starch and a cellulose. It is added to a plastic to provide a shape-decaying property to the compound.

As for the examples of photo-degrading property, there are compounds where a carbonyl group is introduced. Besides, there may be some cases where a UV absorbent may be added to accelerate photo-degradation.

As for such a decomposable plastic as mentioned above, those described in, for example, "Kagaku To Kogyo", Vol. 64, No. 10, pp. 478–484, (1990); and "Kinozairyo", July, 1990 Issue, pp. 23–34 can be used. It is also allowed to use the decomposable plastics available on the market including, for example, Biopol, by I.C.I., Eco, by Union Carbide.; Ecolite, by Eco Plastic Co.: Ecostar, by St. Lawrence Starch Co.; and Knuckle P, by Japan-Unicar Co., respectively.

The above-mentioned moisture resistive packaging material has a moisture transmission coefficient of, preferably, not higher than 10 g·m/m$^2$/24 hrs and, more preferably, not higher than 5 g·m/m$^2$/24 hrs.

As for the means of supplying a solid processing composition to a processing tank in the invention and in the case that the solid processing composition is of the tablet type, for example, there is such a well-known means as described in JP Utility Model Nos. 63-137783/1988, 63-97522/1988 and 1-85732/1989. In short, any means can also be used for this purpose, provided, the means has at least a function for supplying a tablet to a processing tank. In the case that a solid processing composition is of the granule or powder type, there is a well-known means such as a gravitationally dropping type means described in Japanese Utility Model OPI Publication Nos. 62-81964/1987, 63-84151/1988 and JP OPI Publication No. 1-292375/1989 and such a propeller or screw type means as described in Japanese OPI Utility Model Publication Nos. 63-105159/1988 and 63-195345/1988. However, the invention shall not be limited thereto.

As for a preferable means for supplying a solid processing composition to a processing tank, it may be considered to use such a means, for example, that a specific amount of a solid processing composition already weighed and separately put in a package in advance is opened and taken out of the package so as to meet the quantity of light-sensitive material to be processed. To be more concrete, every specific amount of a solid processing composition, that is preferably a replenishing amount thereof for every replenishment, is contained in a package that is sandwiched between at least two packaging materials, and the amount of the composition is then made to be in a state where it can be taken out by separating the packages to two directions or opening a part of the processing composition. The processing composition in the state where it can be readily taken out can be readily supplied to a processing tank provided with a filtering means by naturally dropping the composition. A specific amount of every processing composition is put in a separate tight-sealed package so that the atmospheric air and the aeration between it and any other solid processing composition adjacent thereto can be shielded. Therefore, the composition can be secured to resist any moisture invasion.

As for an embodiment of the invention, the following constitution may be considered that a package is so comprised of at least two packaging materials as to sandwich a solid processing composition between the packaging materials, and the two packaging materials are brought into close contact with or are made adhered to each surface thereof so that the surroundings of the processing composition can be separated apart. When the two packaging materials sandwiching the processing composition between them is pulled toward the different directions from each other, the close contacted or adhered surfaces are separated apart, so that the processing composition can be made in the state where it is ready to be taken out.

As for another embodiment of the invention, it may be considered that a package is so composed of at least two packaging materials as to sandwich a solid processing composition between the packaging materials, and one of the two packaging materials can be opened by applying an external force. The expression "to open a package" herein means a partial notch or partial cut of a packaging material remaining the rest thereof unnotched or uncut. A method of opening a package is that a compression is applied from a package on the side of not opening it, through a solid processing composition, to the direction of the other package to be opened, so that the solid processing composition is forcibly pushed out. Or, it may also be considered that a solid processing composition is made ready to be opened by making a partial cut or notch on a package on the side where the package is to be opened by making use of a sharp-edged member.

A supply starting signal is generated by detecting information on the amount of processing. A supply stopping signal is generated by detecting information on the completion of supply of a specified amount. When a processing agent is packed separately and it is necessary to unseal it, upon reception of such supply starting signal, the driving means for separation or opening, and upon reception of such supply stopping signal, the driving means for separation or opening is disabled.

The above solid processing composition supplying means is preferably equipped with a controlling means for adding a given amount of the solid processing composition according to information on the amount of processing of light-sensitive material. In the present invention, it is essential for the developing machine, preferably the automatic processing machine to keep the component concentration in each processing tank constant and hence stabilize photographic performance. The information on the amount of processing of silver halide photographic light-sensitive material is a value in proportion to the amount of the silver halide photographic light-sensitive material to be processed by a processing solution or the amount of the silver halide photographic light-sensitive material already processed by a processing solution or the amount of the silver halide photographic light-sensitive material being processed by a processing solution, offering a direct or indirect index of the reduction in the amount of the processing agent in the processing solution. This information may be detected at any timing, before or after light-sensitive material transportation into the processing solution or during its immersion in the processing solution. It may also be physical parameters such as the concentration of the processing solution contained in the processing tank, concentration change, pH or specific gravity or the amount discharged after drying the processing solution.

Although any portion is acceptable to add the solid processing composition in the present invention, as long as it is located in the processing tank, preference is given to a portion communicating with the processing portion for the light-sensitive material and allowing the processing solution to flow to/from the processing portion. The preferred configuration is such that a given amount of processing solution is circulated to/from the processing portion to allow the dissolved components to be transferred to the processing portion. It is preferable to add the solid processing composition into a processing solution being warmed.

Usually, the automatic processing machine is equipped with an electric heater to warm processing solutions, wherein, as a general method, a heat exchanger is provided in the auxiliary tank connected to the processing layer, which auxiliary tank is equipped with a pump for supplying the solution at constant rate from the processing tank to have constant temperature.

A filter is usually arranged to remove crystalline foreign substances occurring due to contamination or crystallization in the processing solution.

It is most preferable to add the solid processing agent to a warmed portion communicating with the processing portion like this auxiliary tank. This is because the insoluble components of the added processing agent are isolated from the processing portion by the filtering portion to prevent the solids from entering the processing portion and adhere to the light-sensitive material etc. so that dissolubability of the solid processing agent becomes extremely favorable.

Also, when a processing agent receiving portion, along with the processing portion. is provided in the processing tank, it is preferable to provide a shield or another device to avoid direct contact of the insoluble components with the film etc.

For the filter and filtering apparatus, any material can be used, as long as it is commonly used in ordinary automatic processing machines, and the effect of the present invention is not affected by any particular structure or material.

The solid processing composition in the present invention is added to the processing tank respectively separate from the replenishing water. Aforesaid replenishing water is supplied from the replenisher water tank.

The solid processing composition used in the invention contains a saccharide and/or compounds represented by formulas (B) and (C) described later. The saccharide content of the solid processing composition is preferably 0.5% to less than 30% by weight, and more preferably 3% to less than 20% by weight.

The saccharide in the invention refer to a monosaccharide or polysaccharide in which the monosaccharide binds through a glycosid bondage or decomposition compounds thereof.

The monosaccharide refers to as a polyhydroxy aldehyde, polyhydroxy ketone or their derivatives such as reduced derivatives, oxidized derivatives, deoxy derivatives, amino derivatives or thio derivatives. Most of them are represented by the general formula $C_nH_{2n}O_n$. The monosaccharide in the invention includes derivatives derived from the saccharide skelton represented by the above formula. The preferable are sugar alcohols having a primary or secondary alcohol group to which an aldehyde or ketone group is reduced.

The polysaccharide includes celluloses, starches or glycogens. The celluloses include derivatives such as cellulose ethers in which all or a part of hydroxy group are etherified, starches include maltose or dextrins that starches are hydrolyzed to various decomposition compounds. Celluloses may be in an alkali salt form in view of solubility. Among the polysaccharides, celluloses or dextrins are preferably used, and dextrins are more preferably used.

The examples of the preferred monosaccharides in the invention are listed below.

Erithorit (produced by Mitsubishi Kasei Shokuhin Co. Ltd., Erythritol)

D-sorbitol

L-sorbitol

D-mannitol

L-mannitol

D-iditol

L-iditol

D-talitol

L-talitol dulcin allodulcitol

The examples of polysaccharides and their decomposition compounds in the invention are listed below.

α-Cyclodextrin

β-Cyclodextrin

γ-Cyclodextrin

Hydroxypropyl-α-cyclodextrin

Hydroxypropyl-β-cyclodextrin

Hydroxypropyl-γ-cyclodextrin

Maltodextrin

The weight average molecular weight of dextrins used in the invention may be any, but it is preferably 180 through 10,000, and more preferably 700 to 5,000.

Saccharides exist widely in the nature, and are available on the market. The derivatives can be readily prepared by reduction, oxidation or dehydration reactions. The starch decomposition compounds available on the market include Pineflow, Pine-dex series, Food-tex, Max 100, Glistar P, MPD, H-PDX and Stuco-dex produced by Matstani Kagaku Co., Ltd. or Oil Q series produced by Nihon Yushi Co., Ltd.

The compound represented by formula (B) in the invention will be explained below.

$$HO—(A_1—O)l_1—(A_2—O)l_2—(A_3—O)l_3—H \qquad \text{formula (B)}$$

wherein $A_1$, $A_2$ and $A_3$ independently represent a substituted or unsubstituted, straight-chained or branched alkylene group, and may be the same or different.

The substituent includes a hydroxy group, a carboxy group, a sulfonyl group, an alkoxy group, a carbamoyl group and a sulfamoyl group. The preferred are a compound in which $A_1$, $A_2$ and $A_3$ independently represent an unsubstituted one. The most preferred are a compound in which $A_1$, $A_2$ and $A_3$ independently are $—CH_2CH_2—$ or $—CH(CH_3)CH_2—$.

$l_1$, $l_2$ and $l_3$ independently represent an integer of 0 to 500, provided that $l_1+l_2+l_3>5$. The preferred are a compound in which at least one of $l_1$, $l_2$ and $l_3$ is preferably 15 or more, and more preferably 20 or more.

When the compound represented by formula (B) is a copolymer consisting of two different monomer units A and B, the compound includes a copolymer having the following monomer unit arrangement.

-A-B-A-B-A-B-A-B-A-B-

-A-A-B-A-B-B-A-A-A-B-A-A-B-B-A-

-A-A-A-A-A-A-B-B-B-B-B-B-A-A-A-A-A-

Of these copolymers, especially preferable is a block polymer (pluronic type nonionic compound) obtained from ethylene glycol and propylene glycol, which is represented by the following formula (B-1):

$$HO—(CH_2CH_2—O)l_4—[CH(CH_3)CH_2—O]l_5—(CH_2CH_2—O)l_6—H \qquad \text{formula (B-1)}$$

wherein $l_4$, $l_5$ and $l_6$ are the same as $l_1$, $l_2$ and $l_3$ in the above formula (B).

In the compound represented by formula (B-1), the ethylene oxide content of the compound is preferably 70% by weight, and more preferably 80% by weight.

The exemplified compounds represented by formula (B) or (B-1) are listed below. MW represents molecular weight.

| HO-($CH_2CH_2$-O)n'-H | Avarage MW |
|---|---|
| B-1 | 300 |
| B-2 | 600 |
| B-3 | 1000 |
| B-4 | 1500 |
| B-5 | 2000 |
| B-6 | 3000 |
| B-7 | 4000 |
| B-8 | 6000 |
| B-9 | 10000 |
| B-10 | 15000 |
| B-11 | 20000 |
| B-12 | 30000 |

MW represents molecular weight.

| HO-($CH_2CH_2$-O)a'-[CH($CH_3$)$CH_2$-O]b'-($CH_2CH_2$-O)c'-H | | |
|---|---|---|
| | Ethylene oxide content (weight %) | Average MW |
| B-1-1 | 80 | 8350 |
| B-1-2 | 80 | 10800 |
| B-1-3 | 50 | 4600 |
| B-1-4 | 70 | 6500 |
| B-1-5 | 80 | 5000 |
| B-1-6 | 50 | 3500 |
| B-1-7 | 70 | 7850 |
| B-1-8 | 50 | 4150 |

In the above, n' represents an integer of 5 or more, and a', b' and c' are the same as $l_1$, $l_2$ and $l_3$ denoted in the above formula (B).

Of the compounds represented by formula (B) or (B-1), the most preferable is polyethylene glycol (referred to also as PEG). The polyethylene glycol has an average molecular weight of preferably 2000 to 20000, and more preferably 3000 to 15000.

The molecular weight herein referred to is obtained from a hydroxyl value.

Compounds represented by formula (B) may be used singly or in combination.

R—SxOyM formula (C)

wherein R represents an aliphtic group, an aromatic group or a heterocyclic group; x represents 1 or 2; y represents an integer of 2 to 8; and M represents a cation.

The organic sulfur-containig compound represented by formula (C) will be explained below.

The content of the organic sulfur-containig compound in the solid processing composition is 0.01 to 3.0% by weight, preferably 0.1 to 2.5% by weight, and more preferably 0.5 to 2.0% by weight.

The aliphatic group represented by R includes an alkyl, alkenyl or alkinyl group, and the alkyl group includes methyl, ethyl, propyl, butyl, t-butyl, pentyl, cyclopentyl, hexyl, cyclohexyl, octyl and dedecyl. The alkyl group may have a substituent such as a halogen atom (for example, chlorine, bromine, fluorine), an alkoxy group (for example, methoxy, ethoxy, 1,1-dimethylethoxy, hexyloxy, dodecyloxy), an aryloxy group (for example, phenoxy, naphthyloxy), an aryl group (for example, phenxyl, naphthyl), an alkoxycarbonyl group (for example, methoxycarbonyl, ethoxycarbonyl, butoxycarbonyl, 2-ethylhexylcarbonyl), an aryloxycarbonyl group (for example, phenoxycarbonyl, naphthyloxycarbonyl), an alkenyl group (for example, vinyl, allyl), a heterocyclic group (for example, 2-pyridyl, 3-pyridyl, 4-pyridyl, morphoryl, piperidyl, piperazinyl, pyrimidinyl, pyrazolinyl, furyl), an alkinyl group (for example, propagyl), an amino group (for example, amino, N,N-dimethylamino, anilino), a cyano group, or a sulfonamido group (for example, methylsulfonylamino, ethylsulfonylamino, butylsulfonylamino, octylsulfonylamino, phenylsulfonylamino).

The alkenyl group includes vinyl and allyl, and the alkinyl group includes propagyl.

The aromatic group represented by R includes phenyl and naphthyl.

The heterocyclic group represented by R includes pyridyl (for example, 2-pyridyl, 3-pyridyl, 4-pyridyl), thiazolyl, oxazolyl, imidazolyl, furyl, thienyl, pyrrolyl, pirazinyl, piperazinyl, pyrimidinyl, pyridazinyl, selenazolyl, sulfolanyl, piperidinyl pyrazolyl and tetrazolyl.

The above alkenyl, alkinyl, aromatic or heterocycloc group may have, as a substituent, the alkyl group represented by R or the substituent denoted above in the alkyl group.

The group represented by M is preferably a metal cation or an organic cation. The metal cation includes a lithium, sodium or potassium cation, and the organic cation includes ammonium (for example, ammonium, tetramethyl ammonium, tetrabutyl ammonium), phosphonium (for example, tetraphenylphosphonium) and guanidyl.

When the compounds represented by formula (C) are added to the solid composition containing the saccharide and/or compounds represented by formula (B) used in the invention, and compression-molded to tablets, it has proven that lubricity, hardeness and an anti-abrasion property of the resulting tablets are greatly improved.

The exemplified compounds represented by formula (C) are listed below, but are not limited thereto.

$C_2H_5SO_3Na$ C-1

$CH_3(CH_2)_6SO_3Na$ C-2

$CH_3(CH_2)_7SO_3Na$ C-3

$CH_3(CH_2)_5SO_3Na$ C-4

$CH_3(CH_2)_6OSO_3Na$ C-5

$CH_3(CH_2)_7OSO_3Na$ C-6

$CH_3O(CH_2)_2SO_3Na$ C-7

C-8

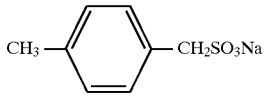

C-9

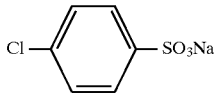

C-10

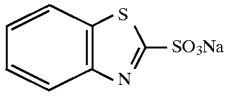

C-11

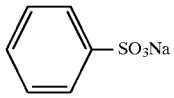

C-12

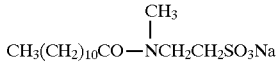

$CH_3(CH_2)_{11}SO_3Na$ C-13

The emulsion used for the silver halide photographic light sensitive material in the present invention can be produced by a conventional method. The preferably used silver halide emulsion is a type mono-dispersed emulsion having high iodide content inside disclosed in Japanese Patent OPI. Publication Nos. 177535/1984, 802237/1986, 132943/1986 and 49751/1988 and Japanese Patent Application No. 238225/1988. The crystal habit may be cubic, tetradecahedral, octahedral, or crystals having a (111) and (100) face.

The crystal structure of silver halide may be composed of a silver halide composition wherein inside and outside are different.

Another silver halide emulsion preferably used in the invention is tabular silver halide grains having an aspect ratio of 1 or more. Such tabular grains improve spectral sensitization efficiency, image graininess or image sharpness. These emulsions are prepared according to methods disclosed in British Patent No. 2,112,157, U.S. Pat. Nos. 4,439,520, 4,433,048, 4,414,319 and 4,434,226 and Japanese Patent OPI. Publication Nos. 113927/1983, 127921/1983, 138342/1988, 284272/1988 and 305343/1988. Specifically, methods disclosed in Japanese Patent OPI. Publication No. 6-138568 (pages 1–3), Japanese Patent OPI. Publication No. 177535/1984 (pages 2–5), and Japanese Patent OPI. Publication No. 42146/1987 (pages 14–15) are preferably used.

Another silver halide emulsion more preferably used in the invention is silver bromoiodide, silver bromochloroiodide, silver bromide, silver bromochloride or silver chloride having a silver iodide content of less than 3 mol %. Still another silver halide emulsion especially more preferably used in the invention is silver bromochloride having a silver chloride content of 50% or more or silver chloride. The above-mentioned emulsion may be either of a surface latent image type wherein latent images are formed on the surface of grains, an inner latent image type wherein latent images are formed inside of the grains or a type wherein latent images are formed on the surface and inside of the grains. To these emulsion, at a step of physical ripening or of preparation of grains, for example, cadmium salt, lead salt, zinc salt, thalium salt, iridium salt or its complex salt, rhodium salt or its complex salt and iron salt or its complex salt may be added. In order to remove soluble salts from the emulsion, a noodle washing method and a floculation precipitation method can be used. The preferable washing methods include a method that uses an aromatic hydrocarbon aldehyde resin containing a sulfo group described in Japanese Patent Publication No. 16086/1960 or a desalting method that uses polymer coagulation agents illustrated G-3 and G-8 described in Japanese Patent OPI. Publication No. 158644/1988. In the chemical sensitization of the emulsion of the invention gold sensitization, sulfur sensitization, reduction sensitization and chalcogenide sensitization are carried out.

The silver halide emulsion in the invention can be spectrally sensitized. The spectral sensitizing dye used includes cyanine dyes, merocyanine dyes, complex cyanine dyes, complex merocyanine dyes, holopolar cianine dyes, hemicyanine dyes, styryl dyes, and hemioxonol dyes, complex merocyanine dyes, and holopolar dyes, and these dyes may be used singly or in combination.

The examples thereof include oxacarbocyanine dyes, benzoimidazolocarbocyanine dyes, and benzoimidazoloxacarbocyanine dyes disclosed in Japanese Patent O.P.I. Publication No. 5-113619. The dyes having sensitization effect in the blue light range disclosed in Japanese Patent O.P.I. Publication No. 6-332102 are preferably used. These dyes may be used singly or in combination.

These sensitizing dyes are preferably added as a solution in which they are dissolved in an organic solvent such as methanol. The addition amount of the sensitising dyes is varied due to kinds of the dyes or emulsion conditions, but is preferably 10 to 900 mg, and more preferably 60 to 400 mg. The sensitizing dyes are added to the emulsion preferably before the chemical ripening step, and may be separately added sensitizing dyes are added to the emulsion more preferably during from completion of silver halide grain growth to completion of the chemical ripening step, and are added especially preferably before beginning of the chemical ripening step.

In order to stop chemical sensitization (chemical ripening), a chemical ripening stopping agent is preferably used in view of emulsion stability. The chemical ripening stopping agent includes a halide such as potassium bromide or sodium chloride), and an organic compound known as an anti-foggant or a stabilizing agent such as 4-hydroxy-6-methyl-1,3,3a, 7-tetrazaindene. The compound may be used singly or in combination.

For the emulsion used in the silver halide photographic light sensitive material of the invention, various additives for photographic use can be used in a step before or after physical ripening or chemical ripening. For example, hydrazine compounds or tetrazorium salts may be added.

The support used in the invention includes a support described on page 28 of RD-17643 and on page 1009 of RD-308119 above.

The suitable support includes a plastic film. In order to enhance adhesivity of the surface of the support to a coating layer, a subbing layer may be provided on the support or corona discharge and UV ray irradiation may be given to the surface. The cross-over cut layer or an anti-static layer may be also provided.

The silver halide emulsion layer can be coated on one or each side of the above obtained support. The emulsion layers provided on each side of the support may be the same as or different from each other.

EXAMPLES

The examples of the invention will be explained below, but the invention is not limited thereto.

Example 1

The light sensitve material for evaluation was prepared as follows. (Preparation of light sensitive material) Preparation of seed emulsion-1

The seed emulsion-1 was prepared by the following method.

| | |
|---|---|
| A 1 | |
| Ossein gelatin | 24.2 g |
| Water | 9557 ml |
| Polypropyleneoxy-polyethyleneoxy-disuccinate sodium salt (10% ethanol solution) | 6.78 ml |
| Potassium bromide | 10.8 g |
| 10% nitric acid | 114 ml |
| B 1 | |
| Aqueous 2.5N $AgNO_3$ solution | 2825 ml |
| C 1 | |
| Potassium bromide | 841 g |
| Water was added to make 2825 ml. | |
| <Solution D> | |
| Aqueous 1.75N KBr solution | an amount for controlling the following silver potential |

By the use of a mixing stirrer described in Japanese Patent Publication Nos. 58288/1983 and 58289/1982, 464.3 ml of each of Solution B 1 and Solution C 1 were added to Solution A 1 in 1.5 minutes at 42° C. by a double-jet method to form a nuclei.

After addition of Solutions B 1 and C 1 was stopped, the temperature of Solution A 1 was elevated to 60° C spending 60 minutes and adjusted to pH 5.0 using a 3% KOH solution. Then, solutions B 1 and C 1 each were added by means of a double jet method for 42 minutes at a flow rate of 55.4 ml/min. The silver potentials (measured by means of a silver ion selecting electrode and a saturated silver-silver chloride reference electrode) during the temperature elevation from 42° to 60° C. and during the re-addition of solutions B-1 and C-1 were regulated to +8 mv and 16 mv, respectively, using Solution D 1.

After the addition, pH was regulated to 6 with 3% KOH. Immediately after that, it was subjected to desalting and washing. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.064 $\mu$m, an average diameter (converted to a circle) of 0.595 $\mu$m. The deviation coefficient of the thickness is 40%, and the deviation coefficient of the distance between the twin planes is 42%.

(Preparation of Em-1)

The tabular silver halide emulsion Em-1 was prepared using the seed emulsion-1 and the following four kinds of solutions.

| A 2 | |
|---|---|
| Ossein gelatin | 34.03 g |
| Polypropyleneoxy-polyethyleneoxy-disuccinate sodium salt (10% ethanol solution) | 2.25 ml |
| Seed emulsion-1 | amount equivalent to 1.218 mol |
| Water was added to make 3150 ml. | |
| B 2 | |
| Potassium bromide | 1734 g |
| Water was added to make 3644 ml. | |
| C 2 | |
| Silver nitrate | 2478 g |
| Water was added to make 4165 ml. | |
| D 2 | |
| *Fine grain emulsion composed of 3 weight % gelatin and silver iodide grains (average grain size of 0.05 μm) | amount equivalent to 0.08 mol |

* Two liters of each of a 7.06 mol $AgNO_3$ solution and a 7.06 mol KI solution was added in 10 minutes to 6.64 liter of a 5.0 weight % gelatin solution containing 0.06 mol of KI. During the fine grain formation, the pH was adjusted to 2.0 using nitric acid, and the temperature was 40° C. After the grain formation the pH was adjusted to 6.0 using a sodium carbonate solution.

A portion of Solution B2, a portion of Solution C2 and a half of Solution D2 were added to Solution A2 in 5 minutes at 60° C. by a triple-jet method with vigorous stirring. Thereafter, a half of each of the remaining solutions B2 and C2 was added in 37 minutes, then, a portion of the remaining solutions B2 and C2 and the remaining solution D2 were added in 15 minutes, and finally, all of the remaining solutions B2 and C2 were added in 33 minutes. During this process, pH was maintained 5.8, and pAg 8.8. Herein, the addition rate of solutions B2 and C2 was varied as a function of time to meet a critical grain growing rate.

Further, Solution D2 was added in an amount of 0.15 mol % of the total silver content to substitute a halogenide.

After the addition, the resulting emulsion was cooled to 40° C., added with 1800 ml of an aqueous 13.8 weight % solution of modified gelatin as a polymer coagulant, which was modified with phenylcarbamoyl (substitution rate of 90%), and stirred for 3 minutes. Thereafter, a 56 weight % acetic acid solution was added to give a pH of 4.6, stirred for 3 minutes, allowed to stand for 20 minutes, and then the supernant was decanted. Thereafter, 9.0 liter of 40° C. distilled water were added, stirred, allowed to stand, and the supernant was decanted. To the resulting emulsion were added 11.25 liter of distilled water, stirred, allowed to stand, and the supernant was decanted. An aqueous gelatin solution and a 10 weight % sodium carbonate solution were added to the resulting emulsion to be pH of 5.8, and stirred at 50° C. for 30 minutes to redisperse. After the redispersion, the emulsion was adjusted at 40° C. to give pH of 5.80 and pAg of 8.06.

When the resulting emulsion was observed by means of an electron microscope, they were tabular silver halide grains having an average diameter of 1.11 μm, an average thickness of 0.25 μm, an average aspect ratio of about 4.5 and a grain size distribution of 18.1%. The average distance between the twin planes was 0.020 μm, and the grains having 5 or more of a ratio of the distance to the thickness was 97% (in number), the grains having 10 or more of the ratio 49%, and the grains having 15 or more of the ratio 17%.

After the resulting emulsion (Em-1) was raised to 60° C., a spectral sensitizer was added in a specific amount in the form of a solid fine particle dispersion, and 10 minute after the addition, a mixture solution of adenine, ammonium thiocyanate, chloroauric acid and sodium thiosulfate and a dispersion of triphenylphosphin selenide were added. Sixty minutes after the addition, the fine grain silver iodide emulsion was added, and the emulsion was ripened for total 2 hours. After completion of the ripening, 4-hydroxy-6-methyl-1,3,3a,7-tetrazaindene (TAI) was added for stabilizing.

The addition amount per mol of AgX of the above additives is shown as follows:

| | |
|---|---|
| 5,5'-Dichloro-9-ethyl-3,3'-di-(sodiumsulfopropyl)-oxacarbocianine anhydride | 2.0 mg |
| 5,5'-Di(butoxycarbonyl)-3,3'-di-(sodiumsulfobutyl)-benzoimidazolocarbocianine anhydride | 120 mg |
| Adenine | 15 mg |
| Potassium thiocyanide | 95 mg |
| Chloroauric acid | 2.5 mg |
| Sodium thiosulfate | 2.0 mg |
| Triphenylphosphin selenide | 0.2 mg |
| Silver iodide fine grain emulsion | 280 mg |
| 4-Hydroxy-6-methyl-1,3,3a,7-tetrazaindene (TAI) | 500 mg |

The solid fine particle dispersion of the spectral sensitizing dye was prepared according to the method described in Japanese Patent Application No. 4-99437/1992. A specific amount of a spectral sensitizer was added to water at 27° C., and stirred at 3500 rpm for 30 to 120 minutes by means of a high speed stirrer (dissolver) to obtain a solid spectral sensitizing dye fine particle dispersion.

The above selenium sensitizer dispersion was prepared as follows. Triphenylphosphin selenide was added in an amount of 120 g to 30 kg of 50° C. ethyl acetate, and stirred to completely dissolve. Photographic gelatin in an amount of 3.8 kg was dissolved in 38 kg of pure water, and 95 g of a 25 wt % aqueous sodium dodecylbenzene sulfonate solution was added to obtain a gelatin solution. The above two solutions were mixed and dispersed at 50° C. for 30 minutes in 40 m/second of a dispersion blade periodical speed, using a high speed stirring dispersion machine having a dissolver of a 10 cm diameter. Thereafter, the ethyl acetate was removed to obtain a 0.3 wt % residual concentration of ethyl acetate while stirring under reduced pressure. The resulting dispersion was diluted with water to make a 80 kg dispersion. The above emulsion was prepared using a portion of this dispersion.

To the thus sensitized emulsion were added the following additives to obtain an emulsion layer coating solution. Further, a protective layer coating solution was prepared.

The above obtained emulsion layer coating solution and the following protective layer coating solution were double layer coated in that order on each side of a blue colored 175 μm thick polyethylene terephthalate film support (a density of 0.15) coated with the following light shieding layer on each side, and dried.

| First Layer (Light Shielding Layer) | |
|---|---|
| Solid dye fine particle dispersion (AH) | 180 $mg/m^2$ |
| Gelatin | 0.2 $g/m^2$ |
| Sodium dedecylbenzene sulfonate | 5 $mg/m^2$ |
| Compound (I) | 5 $mg/m^2$ |
| 2,4-Dichloro-6-hydroxy-1,3,5-triazine sodium salt | 5 $mg/m^2$ |
| Colloidal Silica (average diameter 0.014 μm) | 10 $mg/m^2$ |

-continued

| Second Layer (Emulsion Layer) | |
|---|---|
| Each emulsion obtained above was added with the following additives. | |
| Compound (G) | 0.5 mg/m$^2$ |
| 2,6-Bis(hydroxyamino)-4-diethylamino-1,3,5-triazine | 5 mg/m$^2$ |
| t-Butyl-catechol | 130 mg/m$^2$ |
| Polyvinyl pyrrolidone (molecular weight 10,000) | 35 mg/m$^2$ |
| Styrene-maleic acid anhydride copolymer | 80 mg/m$^2$ |
| Poly(sodium styrenesulfonate) | 80 mg/m$^2$ |
| Trimethylolpropane | 350 mg/m$^2$ |
| Diethylene glycol | 50 mg/m$^2$ |
| Nitrophenyl-triphenyl phosphonium chloride | 20 mg/m$^2$ |
| Ammonium 1,3-dihydroxybenzene-4-sulfonic acid | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Collodal Silica | 0.5 g/m$^2$ |
| Latex (L) | 0.2 g/m$^2$ |
| Dextrin (average molecular weight 1000) | 0.2 g/m$^2$ |
| The gelatin content was adjusted to be 1.0 g/m$^2$. | |
| **Third Layer (Protective Layer)** | |
| Gelatin | 0.8 g/m$^2$ |
| Polymethylmethacrylate matting agent having an area average grain size of 7 $\mu$m) | 50 mg/m$^2$ |
| Hormaldehyde | 20 mg/m$^2$ |
| 2,4-Dichloro-6-hydroxy-1,3,5-triazine sodium salt | 10 mg/m$^2$ |
| Bis-vinylsulfonylmethyl ether | 36 mg/m$^2$ |
| Latex (L) | 0.2 g/m$^2$ |
| Polyacrylamide (molecular weight 10,000) | 0.1 g/m$^2$ |
| Polysodium acrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}$-O-$(CH_2CH_2O)_{11}$-H | 3 mg/m$^2$ |
| $C_8F_{17}SO_2N(C_3H_7)[(CH_2CH_2O)_{15}H]$ | 2 mg/m$^2$ |
| $C_8F_{17}SO_2N(C_3H_7)[(CH_2CH_2O)_4$-$(CH_2)_4SO_3Na]$ | 1 mg/m$^2$ |

The amount was per one side of the support, and the silver amount was 1.6 g/m$^2$ per one side of the support.

Compound (G)

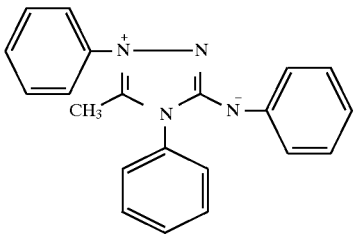

Compound (H)

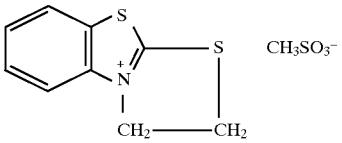

-continued

Compound (I)

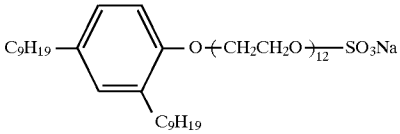

Compound (J)

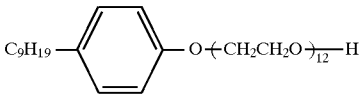

Compound (K)

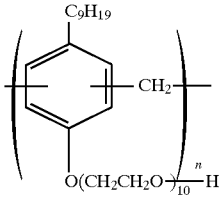

(a mixture of n = 2 to 5)

Compound (S-1)

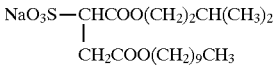

Compound (S-2)

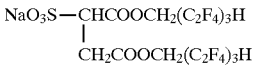

Latex (L)

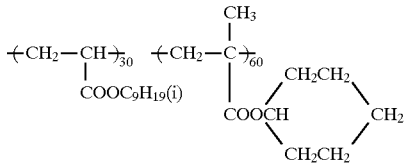

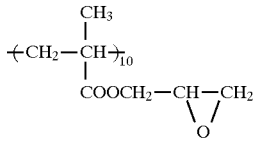

Polysiloxane (S1)

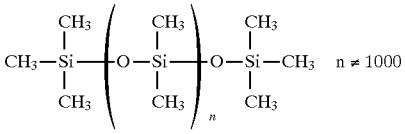

Solid fine particle dispersed dye (AH)

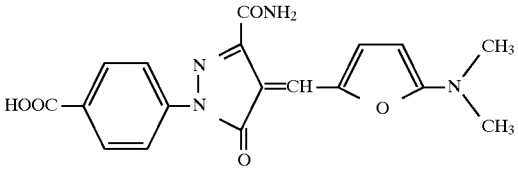

-continued

Compound (O)

$C_{11}H_{23}CONH(CH_2CH_2O)_5H$

Compound (M)

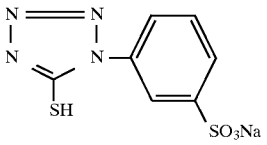

Compound (N)

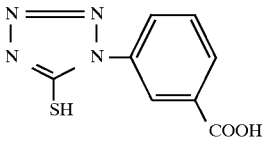

(Preparation of Processing Compositions)

(1) Preparation of Hydroquinone Containing Developer)

(Preparation of Granules A1)

In a bandam mill available on the market was independently pulverized 3000 g of hydroquinone, 400 g of 1-phenyl-3-pyrazolidone, 10 g of N-acetyl-N-acetyl-D,L-penicilamine, 1000 g of boric acid and 500 g of glutaraldehyde sodium bisulfite to an average particle size of 10 μm. The resulting fine particles were mixed, and 700 g of sodium sulfite and 10 g of 5-nitrobenzotriazole were added. A binder sorbitol was further added to make 6,000 g of granules A1 and mixed in a mill for 30 minutes. The resulting mixture was granulated by adding 30 ml of water at room temperature for about 5 minutes in a stirring granulator available on the market and dried at 40° C. for 2 hours in a fluid-bed drier to almost completely remove water.

(Preparation of Granules B1)

In a bandam mill available on the market was independently pulverized 11,000 g of potassium carbonate and 2,000 g of sodium bicarbonate to an average particle size of 10 μm. The resulting fine particles were mixed, and 250 g of $LiOH \cdot H_2O$, 250 g of DTPA·5H, 5 g of 1-phenyl-5-mercaptotetrazole and 4,000 g of sodium sulfite were added. A binder mannitol was further added to make 19,000 g of granules B1 and mixed in a mill for 30 minutes. The resulting mixture was granulated by adding 30 ml of water at room temperature for about 15 minutes in a stirring granulator available on the market and dried at 40° C. for 2 hours in a fluid-bed drier to almost completely remove water.

(Preparation of Tablets A1)

Granules A1 obtained above were uniformly mixed for 10 minutes in a mixer with 150 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, hydroquinone developer, Tablets A1 having a diameter of 30 mm were obtained.

(Preparation of Tablets B1)

Granules B1 obtained above were uniformly mixed for 10 minutes in a mixer with 300 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, alkaline tablets, Tablets B1 having a diameter of 30 mm were obtained.

(2) Preparation of Reductone Containing Developer (Preparation of Granules A2)

In a bandam mill available on the market was independently pulverized 300 g of 1-phenyl-3-pyrazolidone, 10 g of N-acetyl-N-acetyl-D,L-penicilamine, and 500 g of glutaraldehyde sodium bisulfite to an average particle size of 10 μm. The resulting fine particles were mixed, and 1,500 g of sodium metabisulfite, 5,000 g of sodium erythorbate (one of reductones) and 10 g of 5-nitrobenzotriazole were added. A binder sorbitol was further added to make 9,000 g of granules A2 and mixed in a mill for 30 minutes. The resulting mixture was granulated by adding 30 ml of water at room temperature for about 10 minutes in a stirring granulator available on the market and dried at 40° C. for 2 hours in a fluid-bed drier to almost completely remove water.

(Preparation of Granules B2)

In a bandam mill available on the market was independently pulverized 9,000 g of potassium carbonate and 100 g of sodium bicarbonate to an average particle size of 10 μm. The resulting fine particles were mixed, and 250 g of DTPA·5Na, 40 g of a compound represented by the following formula I, 10 g of a compound represented by the following formula II, 7 g of KI, 700 g of sorbitol and 200 g of methyl-β-cyclodextrin were added. A binder mannitol was further added to make 14,000 g of granules B2 and mixed in a mill for 30 minutes. The resulting mixture was granulated by adding 30 ml of water at room temperature for about 15 minutes in a stirring granulator available on the market and dried at 40° C. for 2 hours in a fluid-bed drier to almost completely remove water.

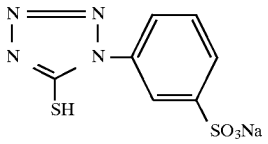

formula (I)

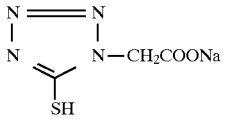

formula (II)

(Preparation of Tablets A2)

Granules A2 obtained above were uniformly mixed for 10 minutes in a mixer with 150 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, reductone developer, Tablets A2 having a diameter of 30 mm were obtained.

(Preparation of Tablets B2)

Granules B2 obtained above were uniformly mixed for 10 minutes in a mixer with 300 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, alkaline tablets, Tablets B2 having a diameter of 30 mm were obtained.

(3) Preparation of Developers α and β, and Starting Developers α and β.

Six tablets of Tablets A1 and 19 tablets of Tablets BE were dissolved in water to make 1 liter, and the pH was adjusted to 10.55 with a KOH or acetic acid solution. Thus, Developer β was obtained. Also, nine tablets of Tablets A2 and 14 tablets of Tablets B2 were dissolved in water to make 1 liter, and the pH was adjusted to 10.25 with a KOH or acetic acid solution. Thus, Developer β was obtained. In the developer tank of an automatic processor SRX-701 produced by Konica Corporation were charged 13.5 liters of the above obtained Developer α or β, and 50 ml of the following starter were added per 1 liter of the developer. The resulting developer was further adjusted to pH 10.00 to obtain Starting Developer α or β.

| Starter for 1 liter working developer solution | |
|---|---|
| KBr | 5.5 g |
| $HO(CH_2)_2S(CH_2)S(CH_2)_2OH$ | 0.05 g |
| N-Acetyl-D,L-penicilamine | 0.10 g |
| Sodium metabisulfite | Amount necessary to obtain the above initial pH |
| Diethylene glycol | 50 g |

Water was added to make 74 ml.

(4) Preparation of Developers γ1 and γ2 and Starting Developers γ1 and γ2

Condensed Developer for 1 liter Working Developer

| | |
|---|---|
| (Part A) | |
| Hydroquinone | 30 g |
| Potassium sulfite | 170 g |
| Boric acid | 20 g |
| Sodium bicarbonate | 20 g |
| Potassium carbonate | 100 g |
| Sodium 3-(5-mercaptotetrazole-1-yl-benzenesulfonate | 0.4 g |
| Diethylene glycol | 70 g |
| 50% Potassium hydroxide solution for pH adjustment | |
| Pure water was added to make 550 ml. | |
| (Part B) | |
| Acetic acid (90%) | 22 g |
| Triethylene glycol | 10 g |
| N-Acetyl-D,L-alanine | 0.2 g |
| 1-Phenyl-3-pyrazolidone | 3.0 g |
| 4-Hydroxy-4-methyl-1-phenyl-3-pyrazolidone | 4 g |
| 5-Nitroindazole | 0.03 g |
| (Part C) | |
| 50% glutaraldehyde solution | 4.0 g |
| Triethylene glycol | 10 g |
| N-Acetyl-D,L-alanine | 0.2 g |
| 1-Phenyl-3-pyrazolidone | 3.0 g |
| 4-Hydroxy-4-methyl-1-phenyl-3-pyrazolidone | 4 g |
| 5-Nitroindazole | 0.03 g |

Parts A, B and C were mixed and water added to make 1 liter. Thus, Developer γ1 was obtained. In the developer tank of automatic processor SRX-701 were charged 13.5 liters of Developer γ1, and 50 ml of the above starter were added per 1 liter of the developer. The resulting developer was further adjusted to pH 10.40 to obtain Starting Developer γ1. (The resulting developer was adjusted to pH 10.55 to obtain Developer Replenisher γ1 for Starting Developer γ1.

Part A' was prepared in the same manner as in Part A above, except that 40 g/liter of sodium erythorbate was added instead of hydroquinone. Part A', B and C were mixed and water added to make 1 liter. Thus, Developer γ2 was obtained. In the developer tank of automatic processor SRX-701 were charged 13.5 liters of Developer γ2, and 50 ml of the above starter were added per 1 liter of the developer. The resulting developer was further adjusted to pH 9.90 to obtain Starting Developer γ2. The resulting developer was adjusted to pH 10.10 to obtain Developer Replenisher γ2 for Starting Developer γ2.

(5) Preparation of Solid Fixer and Starting Fixer

The solid fixer was prepared as follows:

(Preparation of Granules C)

In a bandam mill available on the market was pulverized 15,000 g of an ammonium thiosulfate/sodium thiosulfate (9/1 by weight) mixture to an average particle size of 10 μm. The resulting fine particles were mixed with 500 g of sodium sulfite, 7500 g of $Na_2S_2O_5$ and 1,300 g of Pine-Flow, a binder. The resulting mixture was granulated by adding 50 ml of water in a stirring granulator and dried at 40° C. in a fluid-bed drier to almost completely remove water.

(Preparation of Granules D)

In a bandam mill available on the market was separately pulverized 400 g of boric acid, 1,500 g of aluminum sulfate octahydrate, 1,200 g of succinic acid, 350 g of tartaric acid, and 40 g of 1,8-dihydroxy-3,6-dithiaoctane to an average particle size of 10 μm. The resulting fine particles were mixed, and 300 g of mannitol, 150 g of sorbitol and 200 g of PEG #4000 were added. The resulting mixture was granulated by adding 30 ml of water at room temperature for about 15 minutes in a stirring granulator and dried at 40° C. in a fluid-bed drier to almost completely remove water.

(Preparation of Tablets C)

Granules C obtained above were uniformly mixed for 10 minutes in a mixer with 1,400 g of β-alanine, 4,000 g of sodium acetate, and 220 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, Tablets C having a diameter of 30 mm were obtained.

(Preparation of Tablets D)

Granules D obtained above were uniformly mixed for 10 minutes in a mixer with 750 g of sodium metabisulfite and 220 g of sodium 1-hexanesulfonate at 25° C. and 40% RH or less, and the mixture was compression-tableted in an amount of 10 g per tablet, using Tough Press Correct Model 1527HU produced by Kikusui Seisakusho Co., Ltd., which was modified. Thus, Tablets D having a diameter of 30 mm were obtained.

Twenty three tablets of Tablets C and 5 tablets of Tablets D were dissolved in water to make 1 liter, and the pH was adjusted to 4.70. Thus, a starting fixer was obtained. In the fixer tank of an automatic processor SRX-701 were charged 13.5 liters of the above fixer.

(Processing Method)

The developing tank and fixer tank of automatic processor SRX-701 was modified so that tablets could be incorporated from an incorporating device into each of the chemical mixers. Developer tablets and fixer tablets for 5.0 liters were charged into the developer chemical mixer and fixer chemical mixer, respectively and water (25° to 30° C.) was added to each mixer to obtain 5.0 liters of developer replenisher and 5.0 liters of fixer replenisher. The developer replenisher and fixer replenisher obtained above were replenished to the developer tank and fixer tank, respectively.

The chemical mixer of the developing tank of automatic processor SRX-701 was modified so that developer replenisher can be prepared from the above obtained Parts A, B and C or Parts A', B and C. Thus, Developer Replenisher γ1 was prepared in the same manner as in Starting Developers γ1, except that pH was adjusted to 10.55, and Developer Replenisher γ2 was prepared in the same manner as in Starting Developer γ2, except that pH was adjusted to 10.10. The developer replenishers were replenished to the developer tank.

Three hundred sheets of 10×12 inch light sensitive materials prepared above were exposed and processed to obtain an optical density of 1.0, employing an automatic processor SRX-701 produced by Konica Corporation, which had been modified as above, and the above obtained starting developers and fixer. The processing was carried out at a development temperature of 35° C., at a fixing temperature of 35° C., at a drying temperature of 55° C., and under the remaining conditions as shown in Table 1. Thereafter, 10×12 inch light sensitive material sample obtained was processed and evaluated. The evaluation methods were as follows:

(Evaluation of Residual Color)

The unexposed 10×12 inch material was processed under conditions as described above. The resulting material was placed on a viewing box, and the residual color was observed by the transmitted light.

The evaluation criteria were as follows:

1: No residual reddish color, and no problem

2: Slightly reddish color, but no problem

3: Considerable reddish color, and problematic

4: Red color over the entire surface, and problematic

[Evaluation of CP, (Covering Power)]

The 10×12 inch material light sensitive was exposed for 30 seconds to natural light to obtain a maximum density (Dm). The exposed material was processed under conditions as described above. CP was represented by (Dm-Density of the Support)×100/Coating Amount of silver (g/m$^2$).

The larger CP is, the higher the covering power.

(Evaluation of Glossiness)

The 10×12 inch light sensitive material was exposed for 30 seconds to natural light to obtain a maximum density (Dm). The exposed material was processed under conditions as described above. The resulting material was visually observed by reflected natural light, and evaluated according to the following criteria:

1: Natural black with no problem

2: Slight glistening but no major problem

3: Glistening, and problematic

4: Glistening to the degree causing eye fatigue, and problematic

TABLE 1

| No. | Developer | Average Flow Velocity of Developer | Average Flow Velocity of Fixer | Dry to Dry (Total Processing Time) | Replenishing Amount of Developer Replenisher (ml/m$^2$) | Replenishing Amount of Fixer Replenisher (ml/m$^2$) | Residual Color | CP | Glossiness | Remarks |
|---|---|---|---|---|---|---|---|---|---|---|
| 1 | γ1 | 3 | 3 | 30 | 300 | 300 | 4 | 90 | 3 | Comp. |
| 2 | γ2 | 3 | 3 | 30 | 300 | 300 | 3 | 98 | 3 | Comp. |
| 3 | α | 3 | 3 | 30 | 300 | 300 | 4 | 98 | 3 | Comp. |
| 4 | β | 3 | 3 | 30 | 300 | 300 | 3 | 98 | 3 | Comp. |
| 5 | α | 25 | 3 | 30 | 300 | 300 | 2–3 | 100 | 2 | Comp. |
| 6 | β | 25 | 3 | 30 | 300 | 300 | 1–2 | 110 | 1 | Inv. |
| 7 | β | 25 | 25 | 30 | 300 | 300 | 1 | 110 | 1 | Inv. |
| 8 | β | 50 | 3 | 30 | 300 | 300 | 1 | 112 | 1 | Inv. |
| 9 | β | 110 | 3 | 30 | 300 | 300 | 1 | 115 | 1 | Inv. |
| 10 | β | 50 | 50 | 30 | 300 | 300 | 1 | 112 | 1 | Inv. |
| 11 | β | 50 | 50 | 30 | 200 | 200 | 1–2 | 110 | 1–2 | Inv. |
| 12 | β | 50 | 50 | 25 | 300 | 300 | 1–2 | 110 | 1–2 | Inv. |

Comp.: Comparative, Inv.: Invention

As is apparent from Table 1, the inventive method minimizes residual color, increases Cp, and provides improved glossiness.

What is claimed is:

1. A method for processing a silver halide photographic light sensitive material comprising a support and provided thereon, at least one silver halide emulsion layer, using an automatic processor, the method comprising the steps of:

developing an exposed silver halide photographic light sensitive material with developer in a developer tank of the processor, the developer containing a compound represented by the following formula (1):

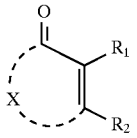

in which $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring; and fixing the developed material with fixer in a fixer tank of the processor, wherein the average flow velocity of the developer is 25 to 80 cm/second.

2. The method of claim 1, wherein the developer contains said compound in an amount of 0.005 to 1.0 mol/liter.

3. The method of claim 1, wherein said compound is ascorbic acid or erythorbic acid.

4. The method of claim 1, wherein the developer is replenished with developer replenisher in the replenishing amount of 350 ml/m$^2$ or less.

5. The method of claim 1, wherein the developing time is 5 to 25 seconds.

6. The method of claim 1, wherein the total processing time (Dry to Dry) is 30 seconds or less.

7. The method of claim 1, wherein the developer is prepared by dissolving a solid developer composition in water, and the fixer is prepared by dissolving a solid fixer composition in water.

8. The method of claim 1, wherein the average flow velocity of the fixer is 20 cm/second or more.

9. The method of claim 1, wherein the average flow velocity of the fixer is 25 to 80 cm/second.

* * * * *